US009052634B2

(12) United States Patent
Furukawa et al.

(10) Patent No.: US 9,052,634 B2
(45) Date of Patent: Jun. 9, 2015

(54) DEVELOPING APPARATUS

(71) Applicant: CANON KABUSHIKI KAISHA, Tokyo (JP)

(72) Inventors: Mitsuhiro Furukawa, Kawaguchi (JP); Tomoyuki Sakamaki, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/446,595

(22) Filed: Jul. 30, 2014

(65) Prior Publication Data

US 2015/0037073 A1 Feb. 5, 2015

(30) Foreign Application Priority Data

Jul. 31, 2013 (JP) ..... 2013-159287

(51) Int. Cl.
*G03G 15/09* (2006.01)
*G03G 15/06* (2006.01)

(52) U.S. Cl.
CPC ..... *G03G 15/065* (2013.01)

(58) Field of Classification Search
CPC ..... G03G 15/065
USPC ..... 399/55, 236, 270
See application file for complete search history.

(56) References Cited

U.S. PATENT DOCUMENTS 6,546,222 B2 4/2003 Sakemi et al.
6,850,722 B2 2/2005 Sakemi et al.
6,973,281 B2 12/2005 Hirobe et al.
6,975,825 B2 12/2005 Sakamaki et al.
6,978,108 B2 12/2005 Sakamaki
7,099,609 B2 8/2006 Hirobe et al.
7,231,154 B2 6/2007 Sakamaki
7,561,838 B2 7/2009 Sakamaki et al.
7,653,336 B2 1/2010 Akashi et al.
7,725,061 B2 5/2010 Sakamaki et al.
7,729,647 B2 * 6/2010 Koike et al.
7,853,186 B2 12/2010 Akashi et al.

(Continued)

FOREIGN PATENT DOCUMENTS

JP 05-249833 A 9/1993
JP 2002-132040 A 5/2002

(Continued)

OTHER PUBLICATIONS

Tomoyuki Sakamaki et al., U.S. Appl. No. 14/382,404, filed Sep. 2, 2014.

*Primary Examiner* — Susan Lee
(74) *Attorney, Agent, or Firm* — Fitzpatrick, Cella, Harper & Scinto

(57) ABSTRACT

A developing apparatus includes a developer carrying sleeve for carrying a developer to a position opposing an image bearing drum. The sleeve is provided with a plurality of groove portions extending in an axial direction of the sleeve, and a developing bias voltage applying device for applying a developing bias voltage to the sleeve. The bias voltage applying device is capable of outputting, as the bias voltage, a voltage of a waveform having a cyclic period including an AC bias portion having an AC component and a DC component superimposed thereto, and a blank portion following the AC bias portion and consisting of a DC component. A width L (m) of the groove, a peripheral speed Vs (m/s) of the sleeve, and a duration t1 (s) of the blank portion in one cyclic period of the bias voltage satisfy L/Vs<t1.

4 Claims, 5 Drawing Sheets

(56) References Cited

U.S. PATENT DOCUMENTS

| | | | |
|---|---|---|---|
| 7,917,069 | B2 | 3/2011 | Sakamaki |
| 7,991,332 | B2 | 8/2011 | Sakamaki |
| 8,355,655 | B2 | 1/2013 | Sakamaki |
| 2012/0201577 | A1 | 8/2012 | Sakamaki et al. |
| 2013/0136506 | A1 | 5/2013 | Sakamaki |
| 2013/0243489 | A1 | 9/2013 | Sakamaki |

FOREIGN PATENT DOCUMENTS

| | | | | |
|---|---|---|---|---|
| JP | 2002132040 | A | * | 5/2002 |
| JP | 2003208027 | A | * | 7/2003 |
| JP | 2004-212519 | A | | 7/2004 |
| JP | 2007-114317 | A | | 5/2007 |

* cited by examiner

DEVELOPING APPARATUS

FIELD OF THE INVENTION AND RELATED ART

The present invention relates to a developing apparatus which is mounted in an image forming apparatus to give developer to an electrostatic latent image formed on an image bearing member of the image forming apparatus, in order to develop the electrostatic latent image into a visible image.

In the field of an image forming apparatus, it has been a common practice to blast the peripheral surface of a development sleeve to roughen the peripheral surface of the development sleeve, in order to enable the development sleeve to satisfactorily bear and carry developer. However, as a development sleeve increases in the length of usage, its peripheral surface is worn, and therefore, reduces in its performance in terms of developer conveyance. In recent years, therefore, there have been proposed various technologies for providing a development sleeve which is relative low in cost, and yet, highly durable and satisfactory in performance in terms of developer conveyance. One of these technologies is to provide the peripheral surface of a development sleeve with multiple grooves which are parallel to the axial line of the development sleeve and are uniform in interval, in order to improve the development sleeve in developer conveyance performance by making make these grooves bear developer.

However, providing the peripheral surface of a development sleeve with multiple grooves, makes a groove portion of the peripheral surface of the development sleeve different in magnetic brush density from portions of the peripheral surface of the development sleeve, which do not have a groove. Therefore, as the development roller is rotated, the development area periodically changes in developer density with a pitch which is equal to the groove pitch. Consequently, low quality images, more specifically, images which appear nonuniform in density are outputted. Further, the periodicity of the nonuniformity corresponds to the groove pitch. In particular, in a case where a photographic image or the like, the substantial area of which is half-toned, the periodicity of the nonuniformity in density attributable to the groove pitch is very conspicuous.

Thus, various remedial technologies for the above described problem have been proposed. One of them regulates the relationship among the moving speed of the peripheral surface (peripheral velocity) of an image bearing member, moving speed of the peripheral surface (peripheral velocity) of a development roller, and groove pitch of the development sleeve, to make the development sleeve higher in peripheral velocity or to reduce the development sleeve in groove pitch, in order to enable a developing device to output images which are significantly less in the above described periodic nonuniformity in density which is attributable to groove pitch, compared to the images outputted by a developing device in accordance with the prior art (Japanese Laid-open Patent Application 2002-132040 (Patent Document 1)). Another one structures a developing device so that the groove intervals become less than the magnetic brush height, in order to enable the developing device to output images which are significantly less in the above described periodic nonuniformity in density, which is attributable to the groove pitch (Japanese Laid-open Patent Application 2007-114317 (Patent Document 2)).

However, increasing a development sleeve in peripheral velocity as disclosed in Patent Document 1 is problematic in that it is likely to cause toner to be scattered, and/or a fixed toner image to be scratched by magnetic brush. Therefore, it is likely to cause a developing device to output images of low quality. Further, reducing a development sleeve in groove intervals as disclosed in Patent Documents 1 and 2 increases the development sleeve in developer conveyance efficiency, making it necessary to reduce a developing device in the gap between its regulation blade and development sleeve. Thus, it is likely for foreign substance in developer to be stuck between the regulation blade and sleeve.

SUMMARY OF THE INVENTION

Thus, the primary object of the present invention is to provide a developing apparatus (device) which can output images which suffer significantly less from the nonuniformity in density attributable to groove pitch, compared to any conventional developing device, while being able to prevent foreign substances from becoming stuck between its regulating blade and development sleeve.

According to an aspect of the present invention, there is provided a developing apparatus comprising a sleeve for carrying a developer to a position opposing an image bearing member, wherein said sleeve is provided with a plurality of groove portions extending in an axial direction of said sleeve; and a developing bias voltage applying device for applying a developing bias voltage to said sleeve, wherein said developing bias voltage applying device is capable of outputting, as the developing bias voltage, a voltage of a waveform having a cyclic period including an AC bias portion comprising an AC component and a DC component superimposed thereto, and a blank portion following the AC bias portion and consisting of a DC component, wherein a width L (m) of the groove, a peripheral speed Vs (m/s) of said developing sleeve, and a duration t1 (s) of the blank portion in one cyclic period of the developing bias voltage satisfy $L/Vs<t1$.

Further features of the present invention will become apparent from the following description of exemplary embodiments.

DESCRIPTION OF THE PREFERRED EMBODIMENTS

Hereinafter, few of the preferred embodiments of the present invention are described in detail with reference to appended drawings. By the way, the developing device in each of the following embodiments is for an image forming apparatus of the so-called tandem type. However, the present invention is also applicable to developing devices which are partially or entirely different in structure from those in the following embodiments.

That is, an image forming apparatus by which a developing device in accordance with the present invention is employed may be of either the so-called tandem, or single-drum type. Further, it may be of either the intermediary transfer type, or direct transfer type. Further, the developer to be used by a developing device in accordance with the present invention may be two-component developer or single-component developer. Further, the present invention is applicable to various image forming apparatuses, such as various printers, copying machines, facsimile machines, multifunction image forming apparatuses, which are combinations of one of the image forming apparatuses in the following embodiments, additional devices, equipments, housing, etc.

Embodiment 1

Image Forming Apparatus

Figure 1:
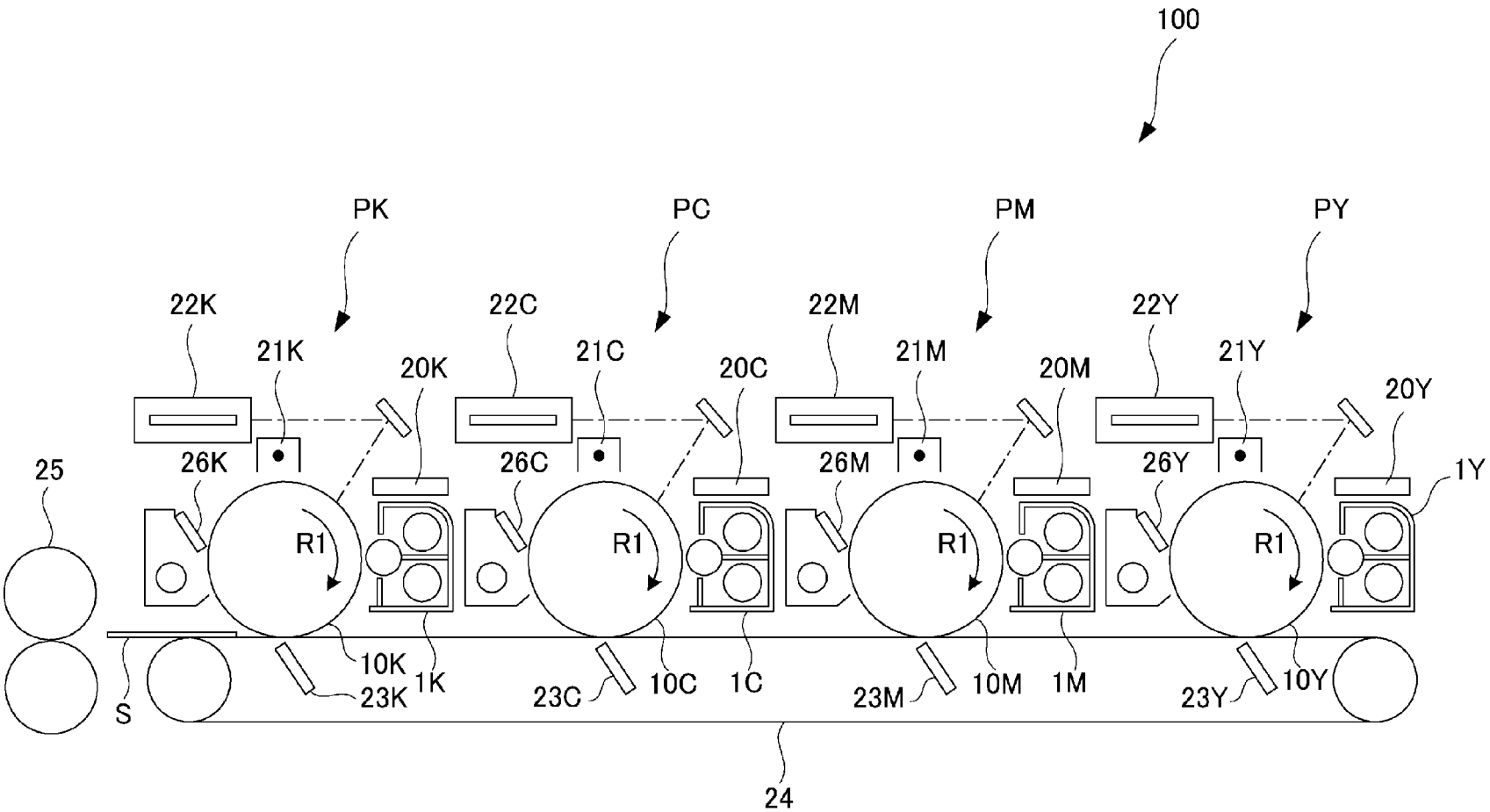
FIG. 1 is a schematic sectional view of the image forming apparatus in the first embodiment of the present invention, and shows the general structure of the apparatus.

FIG. 1 is a schematic sectional view of the image forming apparatus in the first embodiment of the present invention. It shows the general structure of the apparatus.

Referring to FIG. 1, the image forming apparatus 100 is a full-color printer of the so-called tandem type, and also, of the recording medium conveyance belt type. That is, it has a recording medium conveyance belt 24, and yellow (Y), magenta (M), cyan (C) and black (K) image forming stations PY, PM, PC and PK, which correspond in color to the images they form, one for one, and which are aligned in tandem along the recording medium conveyance belt 24.

To the recording medium conveyance belt 24, sheets S of recording medium are sequentially conveyed from an unshown recording medium cassette with such a timing that the arrival of each sheet S at the image forming station P coincides with the arrival of a toner image on the photosensitive drum 10Y at the image forming station P. In the image forming station PY, a yellow toner image is formed on the photosensitive drum 10Y, and is transferred onto the sheet S on the recording medium conveyance belt 24. In the image forming station PM, a magenta toner image is formed on the photosensitive drum 10M, and is transferred onto the sheet S on the recording medium conveyance belt 24. In the image forming stations PC and PK, cyan and black toner images are formed on the photosensitive drums 10C and 10K, respectively, and are transferred onto the sheet S on the recording medium conveyance belt 24.

After the transfer of the four toner images, different in color, onto the sheet S of recording medium, the sheet S is separated from the recording medium conveyance belt 24 with the utilization of the curvature of the recording medium conveyance belt 24, and is sent into a fixing device 25, through which the sheet S is conveyed while being subjected to heat and pressure. Consequently, the toner images are fixed to the surface of the sheet S. Then, the sheet S is discharged from the image forming apparatus 100.

The image forming portions PY, PM, PC and PK are the same in structure, although they are different in the color (yellow, magenta, cyan, and black) of the developer used by their developing devices 1Y, 1M, 1C and 1K, respectively. Hereafter, therefore, suffixes Y, M, C and K, which differentiate the image forming stations PY, PM, PC and PK, are not shown, and the four image forming stations PY, PM, PC and PK are described together as image forming stations P about their structure and operation.

The image forming portion P is provided with a charging device 21 of the corona type, an exposing device 22, a developing device 1, first transfer charging device 23, and cleaning device 26, which are disposed in a manner to surround the peripheral surface of the photosensitive drum 10 as an image bearing member. The photosensitive drum 10 is provided with a photosensitive layer, which is the outermost layer of the photosensitive drum 10. It is rotated in the direction indicated by an arrow mark R1 at a preset process speed (which is 300 mm/s in this embodiment). The process speed of the image forming apparatus 100 is the same as the peripheral velocity Vp of the photosensitive drum 10.

The charging device 21 of the corona type uniformly charges the peripheral surface of the photosensitive drum 10 to a preset negative potential level VD (pre-exposer level), by irradiating the peripheral surface of the photosensitive drum 10 with charged particles it discharges (corona discharge). The exposing device 22 writes an electrostatic image of an image to be formed, on the charged portion of the peripheral surface of the photosensitive drum 10, by scanning the charged portion of the peripheral surface of the photosensitive drum 10, with a beam of laser light, while modulating (turning on or off) the beam according to the image formation data obtained by separating the image to be formed, into monochromatic primary color images, with the use of its rotational mirror. The developing device 1 develops the electrostatic image into a toner image, by supplying the photosensitive drum 10 with toner.

The first transfer charging device 23 is in the form of a blade. It presses on the recording medium conveyance belt 24, forming thereby the first transfer station, that is, the portion in which a toner image is transferred from the photosensitive drum 10 onto the recording medium conveyance belt 24, between the photosensitive drum 10 and recording medium conveyance belt 24. As DC voltage which is opposite in polarity from the toner is applied to the first transfer charging device 23, the toner on the peripheral surface of the photosensitive drum 10 is transferred onto the sheet S of recording medium. The toner remaining on the peripheral surface of the photosensitive drum 10 after the transfer is removed by the cleaning device 26. Further, the developing device 1 is replenished with toner by the amount by which the toner in the developing device 1 has been used for an image forming operation, from a replenishment toner container 20. It is two-component developer, which will be described later, that is used by the developing device in this embodiment.

By the way, the application of the present invention is not limited to image forming apparatuses of the so-called direct transfer type, such as the image forming apparatus 100 in this embodiment, in which the toner images formed on the photosensitive drums 10Y, 10M, 10C and 10K, one for one, are directly transferred onto a sheet S of recording medium. That is, the present invention is also applicable to image forming apparatuses (100) of the so-called secondary transfer type, which are provided with an intermediary transferring member, in place of the recording medium conveyance belt 24. In the case of an image forming apparatus of the so-called secondary transfer type, four toner images, different in color, are transferred from the photosensitive drums 10Y, 10M, 10C and 10K, one for one, onto the intermediary transferring member (primary transfer), and then, the four monochromatic toner images, different in color, of which a synthetic multicolor is made up, are transferred together (secondary transfer) from the intermediary transferring member onto a sheet S of recording medium.

[Two-Component Developer]

Next, the developer used by the developing device 1 in this embodiment is described. The developing device 1 uses two-component developer which is a mixture of nonmagnetic toner and magnetic carrier. The toner is made up of resinous coloring particles which is made up of bonding resin, coloring agent, and additives (which are added as necessary), and external additives such as minute particles of colloidal silica and/or the like. The toner used in the developing device 1 in this embodiment is made of negatively chargeable polyester resin, and is 7.0 μm in volume average particle diameter.

The carrier is made up of one of such metallic substances as iron, nickel, cobalt, manganese, chrome, various rare-earth metals, and their alloys, which have been superficially oxidized or not, ferrite oxide particles, or the like. The method for manufacturing magnetic particles used as carrier does not need to be limited to a specific one.

[Developing Device]

Figure 2:
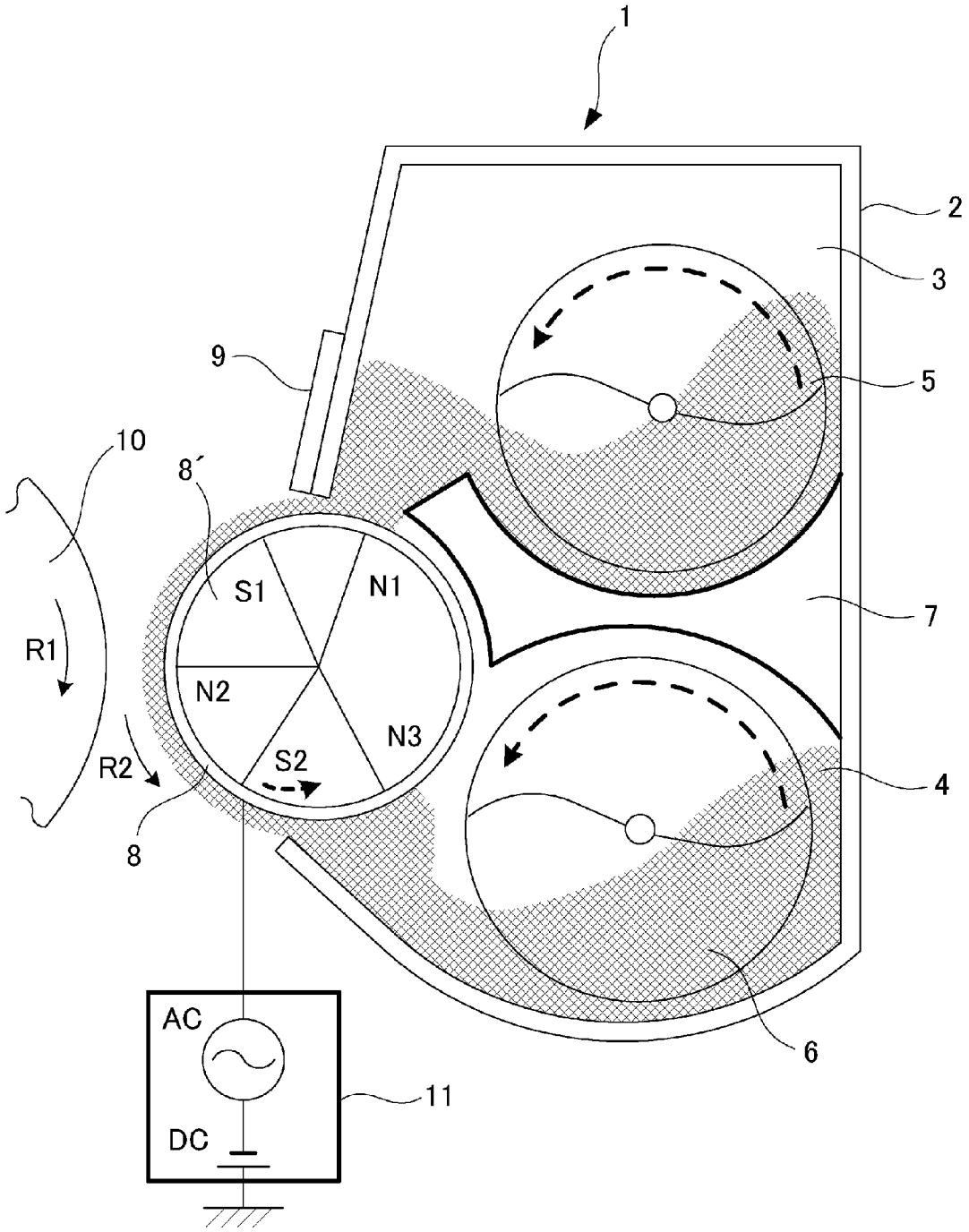
FIG. 2 is a sectional view of the developing apparatus (device) of the image forming apparatus in the first embodiment.

Next, referring to FIG. 2, the developing device 1 is generally described about its structure and operation. FIG. 2 is a sectional view of the developing device 1 of the image forming apparatus 100 in this embodiment.

The developing device 1 has: a developer container (developing device housing) 2, a regulation blade 9, an electrical power source 11 as a development bias applying means, a partitioning wall 7 which is a part of the housing 2, a first conveyance screw 5, a second conveyance screw 6, a development sleeve 8, and a magnetic roller 8'.

The housing 2 holds the two-component developer (which hereafter may be referred to simply as developer) which is a mixture of nonmagnetic toner and magnetic carrier. It has top and bottom chambers (development and stirring chambers 3 and 4, respectively) partitioned by the portion wall 7. The abovementioned first and second conveyance screws 5 and 6 are disposed in the top and bottom chambers, respectively.

The development sleeve 8 is a developer bearing member. It is disposed on the opposite side of the development area from the photosensitive drum 10 so that its peripheral surface opposes that of the photosensitive drum 10. More specifically, the development sleeve 8 is rotatably disposed in such a manner that it is partially exposed through the opening, with which the photosensitive drum 10 side of the housing 2 is provided. The space between the photosensitive drum 10 and development sleeve 8 is the development area (development station) through which developer transfers from the development sleeve 8 onto the photosensitive drum 10. The width of the development area, that is, the width of the gap (SD gap) between the development sleeve 8 and photosensitive drum 10, is roughly 250 μm. The development sleeve 8 is a cylindrical component made of a nonmagnetic substance (aluminum or the like), and is 20 mm in diameter.

The magnetic roller 8' is a magnetic field generating means. It is nonrotationally disposed in the hollow of the development sleeve 8. It has a development pole S1, and developer conveyance poles S2, N1, N2 and N3. The development sleeve 8 is disposed so that the magnetic poles N3 and N2, which are the same in polarity, are positioned next to each other in the housing 2. Since the magnetic field generated by the magnetic pole N3, and that generated by the magnetic pole N1 repel each other. Therefore, the developer separates from the peripheral surface of the development sleeve 8, in the stirring chamber 4.

In operation, as the development sleeve 8 is rotated in the direction indicated by an arrow mark R2, the two-component toner is borne by the development sleeve 8, forming a toner layer (magnetic brush). Then, the toner layer is regulated in thickness by the regulation blade 9. Then, the development sleeve 8 conveys the two-component developer on the development sleeve 8 to the development area where the development sleeve 8 opposes the photosensitive drum 10, and develops the electrostatic latent image on the peripheral surface of the photosensitive drum 10 by supplying the electrostatic latent image with the developer.

The regulation blade 9 is a developer regulating member. It is at the upstream edge of the opening of the developing device housing 2 in terms of the rotational direction of the development sleeve 8, and opposes the development sleeve 8. Thus, as the development sleeve 8 is rotated, the toner layer on the peripheral surface of the development sleeve 8 comes into contact with the regulation blade 9, being thereby made uniform in thickness: the magnetic blush is regulated in height. That is, the regulation blade 9 regulates in thickness the developer layer on the peripheral surface of the development sleeve 8. It is a long and narrow rectangular piece of nonmagnetic substance (aluminum or the like), and is positioned so that its long edges become parallel to the lengthwise direction of the development sleeve 8.

As the developer layer, which is a mixture of toner and carrier, is moved through the gap between the regulating edge (free edge) of the regulation blade 9, and the peripheral surface of the development sleeve 8, it is regulated in thickness. Then, it is conveyed to the development area. The amount by which the tip portion of a magnetic brush formed of the developer is cut off (magnetic brush is regulated in height), and the amount by which the developer is conveyed to the development area, are adjusted by the alteration of the gap between the regulating edge of the regulation blade 9 and the development sleeve 8. In this embodiment, the amount, per unit area, by which developer is allowed to remain on the peripheral surface of the development sleeve 8, by the regulation blade 9 is 30 mg/cm$^2$. Further, the peripheral velocity ratio R of the development sleeve 8 relative to the photosensitive drum 10 is 175%.

Referring to FIG. 2, the partition wall 7 is in the internal space of the developing device housing 2. In terms of the vertical direction of the housing 2, it is roughly in the middle of the housing 2. It extends in the rearward-frontward direction of the housing 2, partitioning the internal space of the housing 3 into the development chamber 3 (top chamber) and stirring chamber 4 (bottom chamber).

The first and second conveyance screws 5 and 6 are means for circulating the developer, while stirring the developer, in the housing 2. They are in the development chamber 3 and stirring chamber 4, respectively. The first conveyance screw 5 is in the bottom portion of the development chamber 3, and is roughly parallel to the development sleeve 8. It conveys the developer in the development chamber 3 toward one of the lengthwise ends of the development chamber 3, in the direction parallel to its axial line, by being rotated. The second conveyance screw 6 is in the bottom portion of the stirring chamber 4, and is roughly parallel to the first conveyance screw 5. It conveys the developer in the stirring chamber 4 toward the other lengthwise end of the housing 2, that is, in the opposite direction from the direction in which the developer is conveyed by the first conveyance screw 5, in the direction parallel to its axial line, by being rotated. As the developer in the housing 2 is conveyed by the rotation of the first and second conveyance screws 5 and 6 in the direction parallel to the rotational axis of the two screws 5 and 6, toward one of the lengthwise ends of the development chamber 3, and the other, respectively, it is circulated between the development chamber 3 and stirring chamber 4 through the unshown passages which are at the lengthwise ends, one for one, of the housing 2 and connect the development chamber 3 and stirring chamber 4. While the developer is circulated between the development chamber 3 and stirring chamber 4, it is supplied to the peripheral surface of the development sleeve 8 from the development chamber 3, through the gap between the regulation blade 9 and partition wall 7, by the rotation of the first conveyance screw 5.

To describe in detail, the first and second conveyance screws 5 and 6 are made up of a rotational axle, and an unshown spiral blade fitted around the rotational axle. Both the rotational axle and spiral blade are made of a nonmagnetic substance. The first and second conveyance screws 5 and 6 are 20 mm in diameter, and 20 mm in pitch. Both the first and second conveyance screws 5 and 6 are rotationally driven at 600 rpm.

[Grooves of Development Sleeve]

Figure 3:
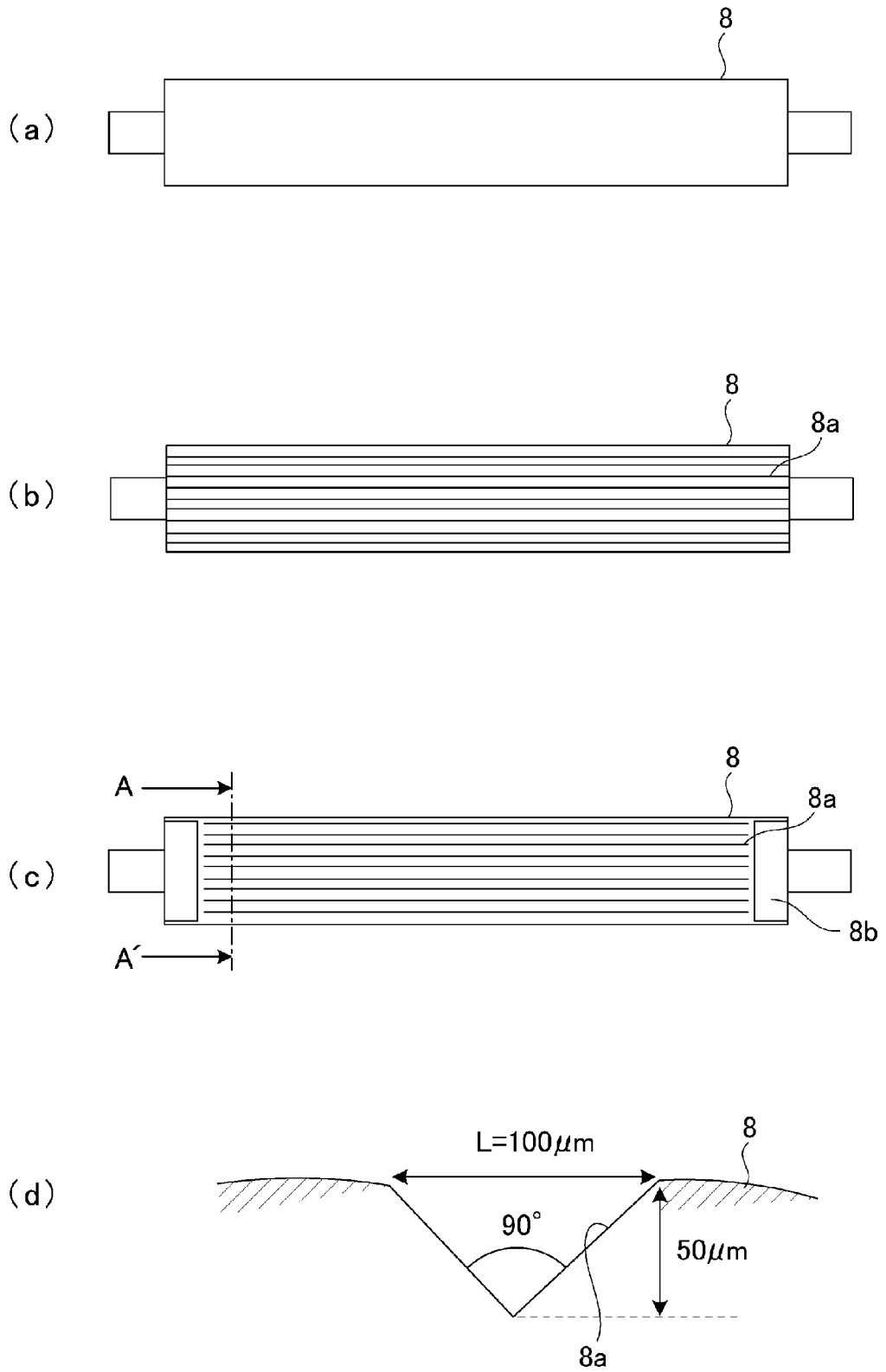
FIGS. 3(*a*)-3(*c*) are drawing for showing the manufacture steps through which the development sleeve of the developing apparatus in this embodiment is manufactured, and FIG. 3(*d*) is a sectional view of the peripheral surface portion of the development sleeve, at a plane indicated by a pair of arrow marks A and A' in FIG. 3(*c*).

Next, referring to FIG. 3, the grooves with which the peripheral surface of the development sleeve 8 is provided are described. FIGS. 3(*a*)-3(*c*) are drawings for showing the steps through which the development sleeve 8 of the developing device 1 in this embodiment is manufactured. FIG. 3(*d*) is a sectional view of one of the grooves and its adjacencies, at a plane indicated by arrow marks A and A' in FIG. 3(*c*).

Referring to FIG. 3(*d*), the peripheral surface of the development sleeve 8 is provided with 50 grooves 8*a*, which extend in the direction parallel to the axial line of the development sleeve 8. The grooves 8*a* are V-shaped in cross-section. They are 50 μm in depth, and 90° in bottom angle. In terms of the lengthwise direction of the development sleeve 8, they are parallel to each other. In terms of the circumferential direction of the development sleeve 8, their intervals are the same.

The following is an example of sequential steps through which the development sleeve 8 in this embodiment is manufactured. First, referring to FIG. 3(*a*), a piece of unprocessed aluminum tube, which is 20 mm in diameter, is prepared. Next, a preset number of grooves 8*a* which are preset in shape, depth, bottom angle, etc., are formed by drawing (aluminum tube through die), etching, or the like, as shown in FIG. 3(*b*). Lastly, the lengthwise end portions of the aluminum tube, in terms of the direction parallel to the axial line of the development sleeve 8, which are not to be coated with developer, are machined to rid the lengthwise end portions of the grooves 8*a*, as shown in FIG. 3(*c*), in order to reduce the lengthwise end portions in developer conveyance performance. That is, the lengthwise end portions of the development sleeve 8 are machined into groove-less portions 8*b*.

In a case where the groove 8*a* is V-shaped in cross-section, 50 μm in depth, and 90° in bottom angle, the width L of the groove 8*a* is 100 μm. Further, the length of time T it takes for one of the grooves 8*a* to pass (relative movement) a given point (phase) in the development area when the development sleeve peripheral velocity ratio R is 175% is 190 μs, which is obtainable with the use of the following equation:

Length *T* of time=groove width *L*/(development sleeve peripheral velocity ratio *R*×peripheral velocity *Vp* of photosensitive drum).

[Development Bias]

Figure 4:
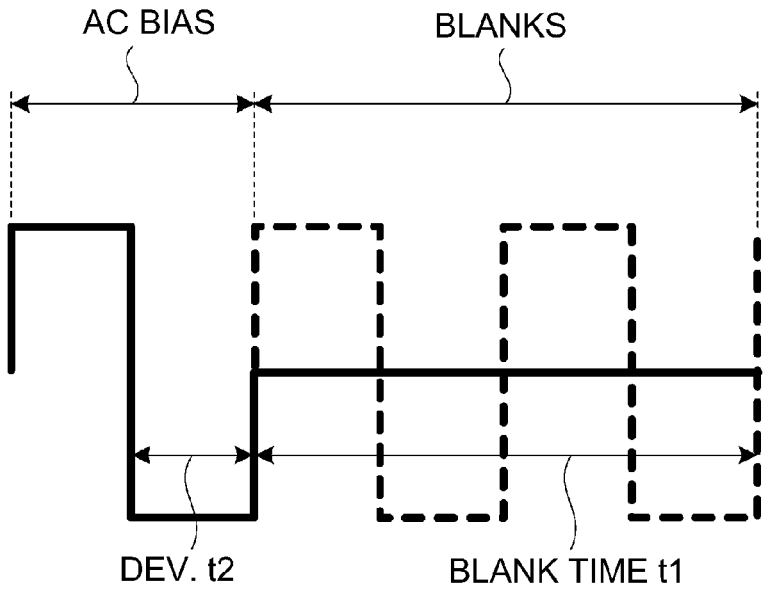
FIG. 4 is a drawing of the waveform of the development bias outputted by the electric power source of the developing apparatus in the first embodiment.

Next, referring to FIG. 4, the development bias used by the developing device 1 in this embodiment is described. FIG. 4 is a drawing of the waveform of the development bias which the electrical power source 11 of the developing device 1 in the first embodiment outputs.

The electrical power source 11 is a development bias applying means. It applies to the development sleeve 8, a development bias which is a combination of an AC component and a DC component. In this embodiment, the AC component of the development bias is rectangular in waveform, and is 10 kHz in frequency. Referring to FIG. 4, this development bias has blank portions, that is, portions having no AC component, which are created by removing the AC component, with preset intervals. In this specification, the pulses which were rectangular in waveform, and were occupying the blank portions of the development bias before they were eliminated with preset interval, are referred to as "blank pulses". That is, the pulses of the AC components, which were removed from the AC component, are referred to as "blank pulses". Further, the portion of the development bias, from which the AC component was removed, that is, the portion of the development bias having only the DC component, are referred to as "blank portion".

That is, in terms of waveform, each period of the development bias which the electrical power source 11 outputs has an alternating portion (AC portion), and a nonalternating portion (blank portion) which follows the alternating portion. The alternating portion is made up of a combination of the AC and DC components. The nonalternating portion (blank portion) is made up of only the DC component.

Referring to FIG. 4, the waveform of the development bias used in this embodiment is a single blank pulse waveform (which hereafter will be referred to as SBP), that is, a combination of two rectangular portions (which is equivalent to single period of AC component), and a blank portion (no pulse) which follows the rectangular portions. By the way, in this specification, the number of pulses which are rectangular in waveform is the number of pulses which are equivalent to one half of each period of the AC component. The length of time the development bias remains blank in each period is referred to as blank time t1, or simply, blank time t1. The sum of the length of time electric field is generated by the development side of the alternating portion of each period of the development bias is referred to as development time t2, or simply, development time t2. Further, the ratio (which hereafter will be referred to as "duty ratio") of the electric field generated by the development side (developer supplying side) of the alternating portion, relative to the electric field generated by the developer recovering side (developer pulling side), was 50%. Here, the electric field on the developing side means the electric field generated by the alternating portion of each period of the development bias so that it causes toner to jump from the development sleeve 8 (developer bearing member) onto the photosensitive drum 10 (image bearing member) in each period of the development bias. The electric field on the developer recovery side means the electric field generated by the alternating portion of each period of the development bias so that it causes toner to be pulled back from the photosensitive drum 10 onto the development sleeve 8.

[Experiments Related to Extent of Nonuniformity in Image Density Attributable to Groove Pitch]

First, the conditions under which experiments were conducted are described. Development bias was varied in blank pulse count (which hereafter may be referred to simply as blank count) to find out the relationship between the extent of the periodic nonuniformity in density, from which some images suffer, and the pitch of the groove 8*a* (groove pitch).

More concretely, half-tone images of A3 size were outputted, as test images, with the use of the image forming apparatus 100, and various development biases in accordance with the present invention, which have a SBP waveform and different in blank count, and conventional development bias, that is, a bias which is rectangular in waveform and has no black pulse. A section (10 mm×400 mm) of each of the outputted images of the test image was scanned with a scanner ES-10000G (product of Epson C., Ltd.) at a resolution of 600 dpi. Then, the data obtained by the scanning were analyzed with the use of FFT (Fast Fourier Transform) to obtain the frequency component (frequency characteristics) of the periodic horizontal stripes which each of the outputted images of the test image had.

In this embodiment, the development sleeve 8 was 20 mm in diameter, and 50 in the number of grooves 8*a*, and 175% in peripheral velocity ratio relative to the photosensitive drum 10. Therefore, it was possible that the nonuniformity in image density attributable to groove pitch would appear at a pitch of 0.718 mm (=20×π/50/1.75). Since the process speed of the image forming apparatus 100, that is, the peripheral surface of the photosensitive drum 10, is 300 mm/s, the most conspicuous portion of the nonuniformity will be related to 418 Hz which is specific to groove pitch.

Referring to Table 1, as for the conditions under which experiments were carried out, in Experiment 1-1, the waveform of the development bias was a SBP, the blank count of which was 2 (pulses); in Experiment 1-2, the waveform of the development bias was a SBP, the blank count of which was 4 (pulses); and in Experiment 1-3, the waveform of the development bias was a SBP, the blank count of which was 8 (pulses). Further, for comparison, a bias, which is rectangular in waveform, that is, a bias, the blank count of which is zero, was used as the development bias.

TABLE 1

| | Waveform | Duty % | Freq. of Rectang. Portions kHz | No. of Blank pulses | Long period Freq. kHz | Developing time μ s | Blank time t1 μ s | Peak value |
|---|---|---|---|---|---|---|---|---|
| Emb. 1-1 | SBP | 50 | 10 | 2 | 5 | 50 | 100 | 0.05 |
| Emb. 1-2 | SBP | 50 | 10 | 4 | 3.3 | 50 | 200 | Non |
| Emb. 1-3 | SPB | 50 | 10 | 8 | 2 | 50 | 400 | Non |
| Comp. Ex. | Rectangular | 50 | 10 | 0 | — | — | 0 | 0.20 |

Next, the results of the experiments are described. Referring to Table 1, the frequency of the rectangular portions (portions with rectangular waveform) is equal to the frequency of the AC component of the development bias. The long period frequency is the frequency of the long period, that is, the period made up of an alternating portion and a blank portion. Peak values are the values which correspond (occurred) at 418 Hz which is specific to the groove pitch.

As will be evident from Table 1, in Comparative Experiment 1, that is, when the development bias was a simple alternating bias which is rectangular in waveform, the value obtained by analyzing the data of the images of the test image was largest (0.20) at 418 Hz which is specific to the groove pitch. In this case, the nonuniformity in image density attributable to the groove pitch was confirmable even with naked eye.

In comparison, in Experiment 1-1, in which the blank count was 2 (pulses), the peak value was 0.05, which was smaller than that in Comparative Experiment 1. Further, in Experiments 1-2 and 1-3, in which the blank count was 4 and 8 (pulses), respectively, no peak was detected; the peak value was zero.

Thus, it is evident that a development bias, such as those used in Experiments 1-1, 1-2 and 1-3, which have a blank portion, can reduce nonuniformity in image density attributable to groove pitch, compared to a development bias, such as the one in Comparative Experiment 1, which has no blank portion (has plain rectangular waveform). It is also evident that increasing the blank time t1 by increasing blank count as in Experiments 1-1, 1-2 and 1-3, can enhance the effect of the development bias having a blank portion.

[Principle of Occurrence of Nonuniformity in Image Density Attributable to Groove Pitch, and Mechanism of Reduction of Nonuniformity]

Next, the principle of occurrence of nonuniformity in image density attributable to groove pitch, and the mechanism which reduces the nonuniformity, are described. First, why the groove pitch affects an image forming apparatus (developing device) in terms of image quality, more specifically, nonuniformity in density, is described. In the case of the development sleeve 8, the peripheral surface of which is provided with the grooves 8*a*, the groove portions 8*a* of its peripheral surface, and the portions of its peripheral surface, which have no groove 8*a*, are different in the magnetic brush density, being therefore different in development performance (ability to develop latent image). Therefore, the portions of the outputted image of the test image, which were developed by the portions of the peripheral surface of the development sleeve 8, which have the groove 8*a*, are higher in density, than those developed by the portions of the peripheral surface of the development sleeve 8, which have no groove 8*a*. That is, the image forming apparatus outputs images which are not uniform in density, and the nonuniformity of which reflects the groove pitch.

Next, the mechanism which reduces an image forming apparatus in nonuniformity in image density, which is attributable to groove pitch is described. The blank portion of the development bias, which is made up of only DC component, is lower in development performance than the alternating portion of the development bias, which is made up of a combination of a DC component and an AC component. However, providing a development bias with a blank portion makes it possible for the timing with which the groove 8*a* passes a given point (phase) in the development area, to coincide with the timing with which the blank portion is outputted. Therefore, it is less likely for the portions of an image developed by the groove portion 8*a*, and those developed by the portion with no groove 8*a*, to be significantly different in density. That is, images formed with the use of development bias having a blank portion are less likely to suffer from nonuniformity in density attributable to groove pitch.

Further, extending the blank time t1 makes it more likely for the timing with which the groove portion 8*a* passes a given point in the development area, to coincide with the timing with which the blank portion of the development bias is outputted. Therefore, it can enhance the effect of the blank time t1 upon the reduction of the nonuniformity in image density attributable to groove pitch.

Making the blank time t1 longer than the groove portion transit time T (=190 μs), as in Experiment 1-1, 1-2 and 1-3, makes it virtually impossible to detect the peak value, that is, makes the peak value virtually zero. In other words, it can enhance the effects of the development bias in this embodiment, upon the reduction of the nonuniformity in image density attributable to the groove pitch. That is, satisfying an inequality (groove portion transit time T<blank time t1) enhances the effect of the development bias in this embodiment, upon the reduction of the nonuniformity in image density attributable to the groove pitch.

By the way, even if the condition (groove portion transit time T<blank time t1) is satisfied, it is possible that the groove portion transit time T will overlap with the timing with which an electric field is generated by the development pulse of the alternating portion of the development bias. However, as long as the condition (groove portion transit time T<blank time t1) is satisfied, it does not occur that the groove portion transit time T overlaps with the electric field generated by the development side pulse by no less than a single period of the development bias, and therefore, it is effective to reduce in severity the nonuniformity image density attributable to groove pitch.

Further, in this embodiment, the development bias is structured so that the frequency of its long period does not become an integer multiple of the frequency (groove pitch frequency) with which a given point on the peripheral surface of the photosensitive drum 10 is passed by the grooves 8*a*. Therefore, even if the electric field which corresponds to the development side of the development bias happens to act on the groove portion 8*a*, it is only by an amount equivalent to a single pulse, and it does not occur that it is always only the electric field generated by the development pulse that acts on the groove portion 8*a*. Therefore, the development bias in this embodiment is still effective to reduce in severity the nonuniformity in image density attributable to groove pitch.

Further, the comparison among Experiments 1-1, 1-2 and 1-3 revealed that lengthening the blank time t1 by increasing the blank count enhances the effects of the development bias upon the reduction in severity of the nonuniformity attributable to groove pitch. However, if the blank count is excessive, it is possible that the development bias reduces the developing device 1 in performance. Therefore, the relationship between the blank count and developmental performance was obtained by experiments.

Figure 5:
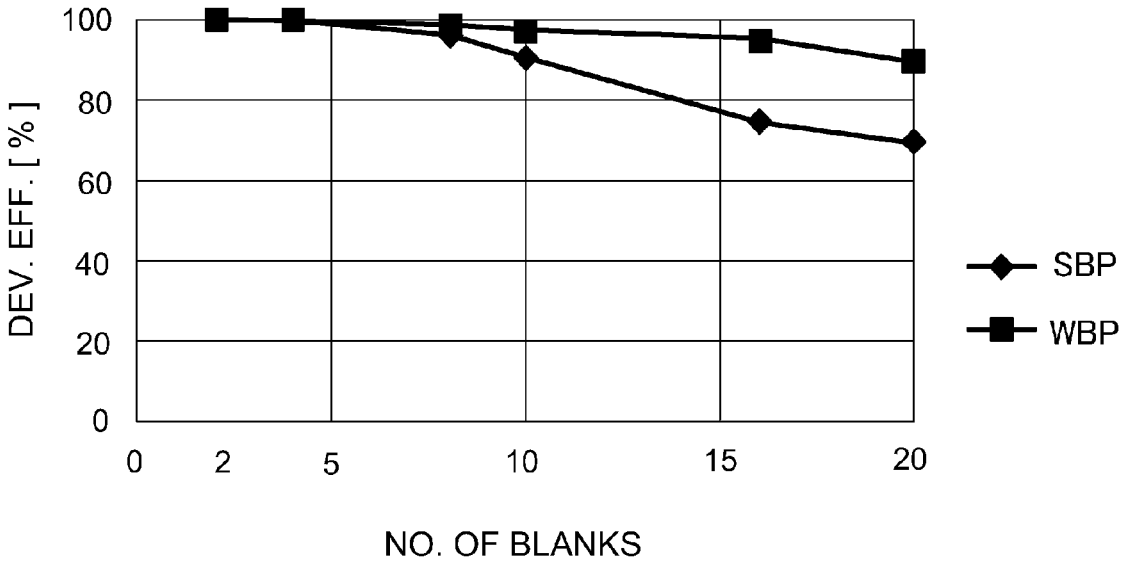
FIG. 5 is a drawing which shows the relationship between the number of the blanks of the development bias outputted by the electric power source of the developing apparatus, and the performance of the developing apparatus, in the second embodiment of the present invention.

FIG. 5 shows the results of the experiments, and shows the relationship between the blank count and the development efficiency [%]. The development efficiency was obtained with the use of a formula ({(post-charge potential level−post-exposure potential level)/(development DC−post-exposure potential level)×100}). Here, "post-charge potential level" is the potential level of a given exposed point of the peripheral surface of the photosensitive drum 10 after the adhesion of toner to the given exposed point by development, and is affected by the state of toner in terms of amount of electric charge. "Post-exposure potential level", means the potential level of a given exposed point of the peripheral surface of the photosensitive drum 10 prior to development. "Development DC" means the potential level of the DC component of the development bias.

Referring to FIG. 5, the development bias, the waveform of which is SBP, was excellent in development efficiency as long as its blank count was in a range of 2-10 pulses. However, in a case where its blank count is no less than 10 pulses, it is rather low in development efficiency. That is, in a case where the ratio between the development time t2 and blank time t1 is no less than 1:10 (blank count is no less than 10), the development bias, the waveform of which is SBP, was conspicuously low development efficiency. On the other hand, in the case of WBP, which will be described later, it was excellent in development efficiency as long as its blank count was in a range of 2-20 pulses. Therefore, from the standpoint of keeping the developing device 1 excellent in development efficiency, it is desired that the blank time t1 and development time t2 are set so that their relationship satisfies a condition ($t1/t2 \leq 10$).

Further, in a case where the blank count is 2 as in Experiment 1-1, the peak value attributable to groove pitch was 0.05. Thus, from the standpoint of reducing the nonuniformity in image density attributable to groove pitch, the blank count is set to a value in a range of 4-10, if the waveform of the development bias is SBP.

As described above, the electric power source 11 of the developing device 1 in this embodiment outputs a development bias, each period of which in terms of waveform is a combination of an alternating portion and a blank portion (nonalternating portion). The alternating portion is a combination of an AC component and a DC component, and a blank portion has only a DC component. The groove portion transit time T and blank time t1 are set so that they satisfy the relationship (groove portion transit time T<blank time t1). Therefore, the timing with which a given groove 8*a* passes a given point in the development area is likely to coincide with the timing with which the blank portion of the development bias is outputted. Therefore, a portion of an image, which is developed by the groove portion 8*a*, and a portion of an image, which is developed by the portion with no groove 8*a*, is less likely to be different in density. That is, this embodiment can reduce a developing device in the nonuniformity in image density, which is attributable to the groove pitch.

Further, in the case of the development bias in this embodiment, the blank time t1 and development time t2 are set to satisfy a formula ($t1/t2 \leq 10$). Therefore, this embodiment can reduce the developing device 1 in the nonuniformity in image density, which is attributable to the groove pitch, while keeping the developing device 1 at an excellent level in terms of development efficiency.

Embodiment 2

Figure 6:
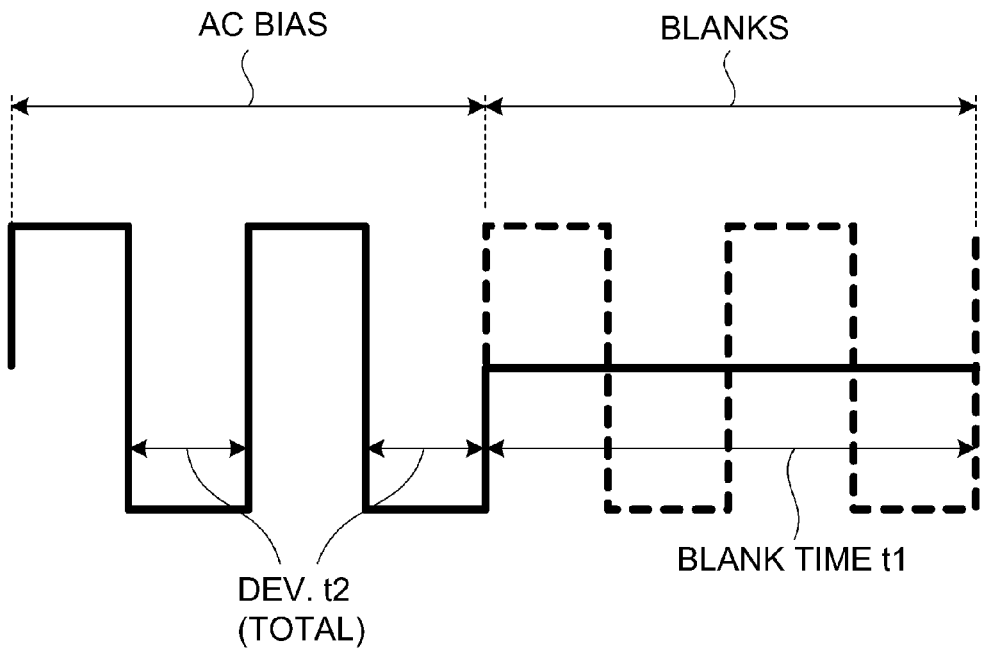
FIG. 6 is a drawing of the development bias which the electric power source of the developing device in the second embodiment of the present invention outputs.

Next, referring to FIG. 6, the output of the electric power source 11 of the developing device 1 in the second embodiment of the present invention is described. FIG. 6 is a drawing of the waveform of the development bias outputted by the electric power source 11 of the developing device 1 in the second embodiment. The image forming apparatus 100 and developing device 1 in this embodiment are the same in structure and operation as those in the first embodiment. Therefore, their structural components which are similar to the counterparts in the first embodiment are given the same referential codes as those given to the counterpart, and are not described here, except for their characteristic features.

In the first embodiment, a SBP was used as the waveform for the development bias. It was varied in the number of blank portions to find out the relationship between the change in the number of blanks and the changes in the severity of the nonuniformity in density, which are attributable to groove pitch.

In comparison, the development bias used by the developing device 1 in this embodiment, is a bias, the waveform of which is such that two alternating portions (4 pulses: two periods of AC component), which are rectangular in waveform, are followed by two blank portions (2 blank pulses: two periods of DC component), as shown in FIG. 6. This type of waveform will be referred to as a double-blank waveform (WBP). In the experiments carried out to test the development bias in this embodiment, variables such as development time t2 were changed to observe the changes in the severity of the nonuniformity in image density, which is attributable to groove pitch. In FIG. 6, the development time t2 is the sum of duration of two development pulses of the alternating portion, that is, duration of two downwardly protruding portions of the waveform.

Referring to Table 2, the waveform of the development bias used by the developing device 1 in this embodiment is the WBP. The developing device 1 in this embodiment was put through Experiments 2-1 and 2-2, in which the development bias was varied in pulse count, blank (pulse) count, long period count, and development time t2 so that the blank time t1 became 200 μs.

More concretely, in Experiment 2-1, the frequency of the alternating portion which is rectangular in waveform was 10 kHz, and blank count, long period frequency, and development time t2 were set to 4, 2.5 kHz, and 100 μs, respectively. For Experiment 2-2, the frequency of the alternating portion which is rectangular in waveform was set to 5 kHz, and blank count, long period frequency, and development time t2 were set to 2, 1.7 kHz, and 200 μs, respectively. That is, Experiment 2-2 was made the same in blank time t1 as Experiment 2-1, and longer in development time t2 than Experiment 2-1. Further, in both Experiments 2-1 and 2-3, the blank time t1 was set so that the condition (groove pass time T<blank time t1) is satisfied.

TABLE 2

| | Waveform | Duty % | Freq. of Rectang. Portions kHz | No. of Blank pulses | Long period Freq. kHz | Developing time μ s | Blank time t1 μ s | Peak value |
|---|---|---|---|---|---|---|---|---|
| Emb. 2-1 | WBP | 50 | 10 | 2 | 2.5 | 100 | 200 | Non |
| Emb. 2-2 | WBP | 50 | 5 | 4 | 1.7 | 200 | 200 | 0.05 |

Next, the results of the experiments are described. As will be evident from Table 2, in Experiment 2-1, unlike in Experiment 1-2 in the first embodiment, in which the waveform of the development bias is SBP, the waveform of the development bias in the second embodiment is WBP, being therefore longer in development time t2. However, the peak value was 0. That is, the development bias in Experiment 2-1 was also effective to reduce the nonuniformity in image density attributable to groove pitch, as the development bias in the first embodiment.

On the other hand, in Experiment 2-2, such nonuniformity in image density that is attributable to groove pitch and is detectable even with naked eyes was not present. However, the peak value was 0.05 which was attributable to groove pitch. That is, the development bias used in Experiment 2-1 was better in results than that in Experiment 2-2. More specifically, although the development bias in Experiment 2-2 satisfied the required relationship between the groove portion transit time T and blank time t2 (groove portion transit time T<blank time t2), and therefore, was effective to reduce the nonuniformity in image density attributable to groove pitch. However, the development bias in Experiment 2-1, which was structured as described above, was more effective to reduce the nonuniformity in image density attributable to groove pitch than the development bias in Experiment 2-2.

To think about the reasons why the development bias in Experiments 2-1 was different in peak value from that in Experiment 2-2, although the development bias in Experiment 2-2 satisfied the condition (groove portion transit time T<blank time t2), it was longer in development time t2 than the development bias in Experiment 2-1. This seems to be the reason why it was less effective to reduce the nonuniformity in image density attributable to groove pitch than the development bias in Experiment 2-1. That is, even if a development bias is structured so that its blank time t1 is extended to satisfy the relationship (groove portion transit time T<blank time t1), it is possible that electric field will be generated by the pulse on the development side while the groove portion 8*a* is moving through the development area. In Experiment 2-2, therefore, the development bias was structured so that it becomes less in the number of the portions which are rectangular in waveform, and the long period frequency, and longer in the development time t2, than the development bias in Experiment 2-1. Therefore, it was inferior in the effectiveness to reduce the nonuniformity in image density attributable to groove pitch, to the development bias in Experiment 2-1.

Therefore, from the standpoint of reducing the occurrence of the nonuniformity in image density attributable to groove pitch, it is desired to set a minimum value for the groove portion transit time T, and also, set the blank time t1, development time t2, and groove portion transit time T so that the condition (development time t2<groove portion transit time T<blank time t1). Structuring the development bias as described above makes it possible to prevent the problem that the groove portion 8*a* is subjected to only the electric field generated by the pulses on the development side, and therefore, can ensure that the development bias is effective to reduce the nonuniformity in image density attributable to groove pitch.

In Experiment 2-1, development time t2 (=100 μs)<groove portion transit time T (=190 μs)<blank time t1 (=200 μs). That is, the condition (development time t2<groove portion transit time T<blank time t1) was satisfied. Therefore, the development bias in Experiment 2-1 reduces the nonuniformity in image density attributable to groove pitch.

In this embodiment, the waveform of the development bias was a WBP. However, as long as the condition (development time t2<groove portion transit time T<blank time t1) is satisfied, a development bias, the waveform of which is other than a WBP or a SBP, can be used as the development bias. For example, the waveform for the development bias may be the so-called triple blank pulse waveform, that is, a waveform structured so that three cycles (six pulses) of AC bias which is rectangular in waveform is followed by a blank portion.

As described above, the developing device 1 in this embodiment is structured so that it satisfies the condition (development time t2<groove portion transit time T<blank time t1). Therefore, it can prevent the problem that it is only the electric field generated by the development side of the development bias that the groove portion 8*a* is subjected. Therefore, it is ensured that the developing device 1 in this embodiment is effective to reduce the nonuniformity in image density attributable to groove pitch.

Embodiment 3

Figure 7:
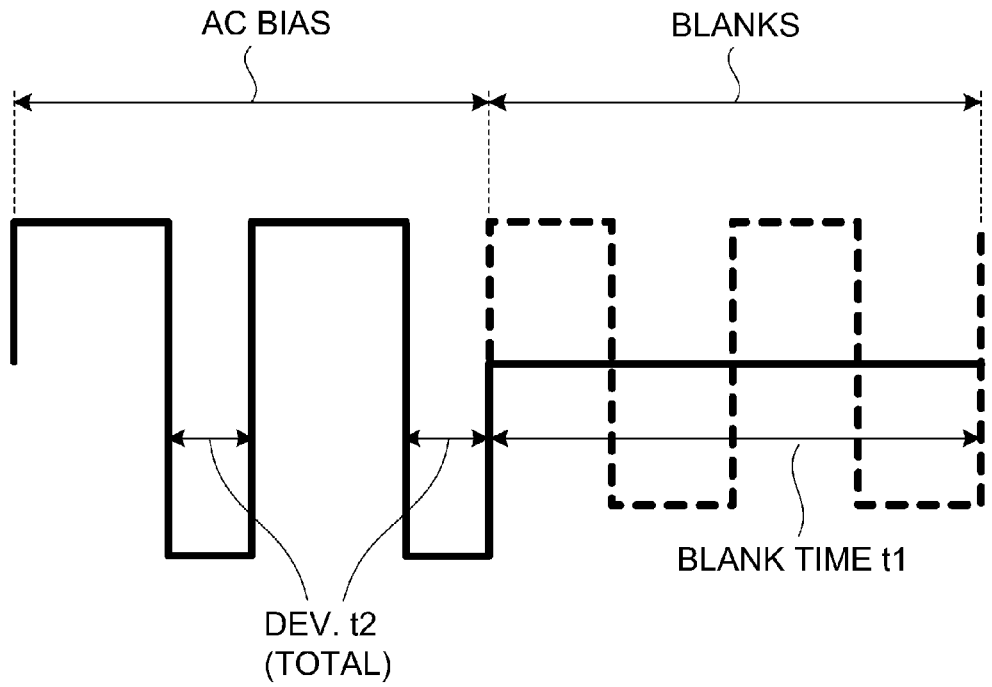
FIG. 7 is a drawing of the development bias which the electric power source of the developing device in the third embodiment of the present invention outputs.

Next, referring to FIG. 7, the output of the electric power source 11 of the developing device 1 in the third embodiment of the present invention is described. FIG. 7 is a drawing which shows the waveform of the development bias which the electric power source of the developing device 1 in this embodiment outputs. The image forming apparatus 100 and developing device 1 in this embodiment are similar in basic structure and operation, to the image forming apparatuses 100 and developing devices 1 in the first and second embodiments. Therefore, their components which are the same or similar in function, as or to, the counterparts in the first and second embodiments, are given the same referential codes as those given to the counterparts, and are not described here, except for their characteristic features in this embodiment.

In the second embodiment, the development bias was structured to satisfy the condition ((development time t2<groove portion transit time T<blank time t1) in order to further reduce the nonuniformity in image density attributable to groove pitch, compared to the development bias in the first embodiment. Here, the parameters for setting the development time t2 are the frequency of the alternating portion which is rectangular in waveform, frequency of the long period, pulse count of the alternating portion of the single period, which is rectangular in waveform, and duty ratio. These parameters can be adjusted to set the development time t2 to make the development time t2 desirable for satisfying the condition (development time t2<groove portion transit time T).

Referring to FIG. 7, in this embodiment, the duty ratio of the alternating portion of the development bias, the waveform of which is a WBP, was set to 60%. That is, the ratio between the development time t2 and recovery time (total length of time developer recovering electric field is active) was set to 4:6. In this case, therefore, the ratio between the strength of the developing electric field and the strength of the developer recovering electric field is 6:4. By the way, the development time t2 in FIG. 7 is the sum of the length of time the developing electric field is generated by the development side of the alternating portion of the development bias, that is, the portions which correspond to the two downwardly protruding portions of the waveform.

As described above, by structuring the development bias so that the duty ratio of the alternating portion of the development bias becomes 60%, it is possible to reduce the development time t2 while keeping the development bias the same in development performance, in order to satisfy the condition (development time t2<groove portion transit time T<blank time t1, compared to the case in which the duty ratio is 50%. Further, not only the duty ratio, but also, the frequency may be set to make the development time t2 become desirable for satisfying the condition. Moreover, the frequency and duty ratio may be set in combination.

The development bias in this embodiment was tested by carrying out Experiments 3-1 and 3-2, which were made different in the number of pulses of the alternating portion, number of blanks, long period frequency, development time t2, and blank time t1, within a range in which the condition (development time t2<groove portion transit time T). Further, both the development bias used in Experiment 3-1 and that in Experiment 3-2 were WBP which was 60% in duty ratio.

More concretely, in Experiment 3-1, the frequency of the alternating portion, which is rectangular in waveform, was set to 10 KHz, and blank count was set to four (pulses). Further, the long period frequency was set to 2.5 kHz, and development time t2 was set to 80 μs. Further, the blank time t1 was set to 200 μs. In comparison, in Experiment 3-2, the frequency of the alternating portion, which is rectangular in waveform, was set to 12 kHz, and the blank count was set to 6 (pulses), and the long period frequency was set to 2 kHz. Further, the development time t2 was set to 67 μs, and the blank time t1 was set to 250 μs. That is, the development bias in Experiment 3-2 was increased in frequency to further reduce the development time duration t2.

TABLE 3

| | Waveform | Duty % | Freq. of Rectang. Portions kHz | No. of Blank pulses | Long period Freq. kHz | Developing time μ s | Blank time t1 μ s | Peak value |
|---|---|---|---|---|---|---|---|---|
| Emb. 3-1 | WBP | 60 | 10 | 4 | 2.5 | 80 | 200 | Non |
| Emb. 3-2 | WBP | 60 | 12 | 6 | 2 | 67 | 250 | Non |

Next, the results of the experiments are described. As will be evident from Table 3, in both Experiments 3-1 and 3-2, the peak value was zero. That is, there was no peak value attributable to groove pitch. In other words, the development bias in this embodiment made it possible to obtain images which do not suffer from the nonuniformity in density attributable to groove pitch.

Changing a development bias in duty ratio to reduce it in development time t2 lengthens the recovery time. However, the recovery time does not contribute to development. Therefore, reducing a development bias in development time t2 by structuring the development bias so that its duty ratio becomes the same as that in Experiments 3-1 and 3-2 can enhance the development bias in its effectiveness for reducing the nonuniformity in image density attributable to groove pitch, as providing a development bias with a blank portion (pulses).

As described above, in the case of the developing device 1 in this embodiment, its development bias is structured so that the duty ratio of its alternating portion is set to make the development time t2 become shorter than the recovery time, and therefore, it can further reduce the nonuniformity in image density attributable to groove pitch, compared to the development bias which is simply provided with a blank pulse (blank portion).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 159287/2013 filed Jul. 31, 2013, which is hereby incorporated by reference.

What is claimed is:

1. A developing apparatus comprising:

a developer carrying member for carrying a developer to a position opposing an image bearing member, wherein said developer carrying member is provided with a plurality of groove portions extending in an axial direction of said developer carrying member; and a developing bias voltage applying device for applying a developing bias voltage to said developer carrying member, wherein said developing bias voltage applying device is capable of outputting, as the developing bias voltage, a voltage of a waveform having a cyclic period including an AC bias portion comprising an AC component and a DC component superimposed thereto, and a blank portion following the AC bias portion and consisting of a DC component, wherein a width L (m) of the groove, a peripheral speed Vs (m/s) of said developing carrying member, and a duration t1 (s) of the blank portion in one cyclic period of the developing bias voltage satisfy, $L/Vs<t1$.

2. An apparatus according to claim 1, wherein a total t2 (s), in one cyclic period of the developing bias voltage, of time duration in which an electric field in a direction of transferring the developer from said developer carrying member to the image bearing member by the AC bias portion satisfies $t2<L/Vs$, where T is a time duration required by a point on a surface of said image bearing member relatively passes the width (L).

3. An apparatus according to claim 2, wherein t1 and t2 satisfy $t1/t2\leq 10$.

4. An apparatus according to claim 2, wherein a duty ratio of the AC bias portion is smaller than of a total of time duration, in one cyclic period, in which an electric field in a direction of transferring the developer back to said developer carrying member from the image bearing member by the AC bias portion.

* * * * *